US005727733A

United States Patent [19]

Ruttenberg

[11] Patent Number: 5,727,733

[45] Date of Patent: Mar. 17, 1998

[54] PULSATING DEVICES

[75] Inventor: Gideon Ruttenberg, 81-465 Date Palm Ave., Indio, Calif. 92201

[73] Assignee: Gideon Ruttenberg, Indio, Calif.

[21] Appl. No.: 588,731

[22] Filed: Jan. 19, 1996

[51] Int. Cl.[6] ..... B05B 1/08

[52] U.S. Cl. ..... 239/99

[58] Field of Search ..... 239/99, 101, 276, 239/533.13, 570; 137/624.14, 853, 895

[56] References Cited

U.S. PATENT DOCUMENTS

| | | | |
|---|---|---|---|
| 4,301,967 | 11/1981 | Hunter | 239/99 |
| 4,642,833 | 2/1987 | Stoltz et al. | 137/853 X |
| 4,846,406 | 7/1989 | Christy | 239/276 X |
| 5,314,116 | 5/1994 | Krauth et al. | 239/99 |
| 5,507,436 | 4/1996 | Ruttenberg | 239/99 X |

FOREIGN PATENT DOCUMENTS

| | | | |
|---|---|---|---|
| 3608621 | 9/1987 | Germany | 239/533.13 |

*Primary Examiner*—Andres Kashnikow
*Assistant Examiner*—Steven J. Ganey

[57] ABSTRACT

This invention relates to pulsating devices which are used for converting a low continuous flow to a high intermittent pulsating flow. The pulsating device consists of an insert, an elastic tube and a casing that is without venting perforations at its outer periphery. The casing surrounds the elastic tube and forms a space between the inner surface of the rigid casing and the outer surface of the elastic tube. By using a casing which has a large space relative to the change in volume of the elastic tube, expansion of the elastic tube can be done without providing venting perforations in the casing. Fluid flows into the pulsator through its inlet at a low controlled continuous flow rate and is ejected through its outlet at a high intermittent pulsating flow. In such a case the volume of air surrounding the elastic tube and enclosed in the casing is only slightly compressed during the expansion of the elastic tube which causes a negligible increase in pressure of the air surrounding the elastic tube.

5 Claims, 2 Drawing Sheets

PULSATING DEVICES

BACKGROUND—FIELD OF THE INVENTION

This invention relates to pulsating devices which are used for converting a low continuous fluid flow to a high intermittent pulsating flow. Such devices are useful for applications in which low flows of fluid have to be applied to relatively large designated areas. Some applications of this invention include pulsating: sprinklers, misters and drippers for irrigation, as well as pulsating: shower heads, dishwasher sprayer, chemical sprayers, etc.

BACKGROUND—DESCRIPTION OF PRIOR ART

My U.S. Pat. No. 4,955,539 describes one type of pulsator which consists of:

a. A receptacle container b. A preset normally-closed pressure responding valve which consists of an elastic tube that surrounds and is in contact with a rigid insert.

c. A long riser or other means for creating hydraulic resistance.

d. A dripper, a flow control, or other means for controlling the flow of a fluid into the container at a relatively low rate.

Fluid that flows into the pulsator through its inlet at a low controlled continuous flow rate is ejected through its outlet at a high intermittent pulsating flow.

My U.S. patent application Ser. No. 07/988,946, now U.S. Pat. No. 5,507,436, describes a second type of a pulsator in which the basic required elements, i.e. a receptacle, a normally-closed preset pressure-responding valve, and an hydraulic resistance, are produced by using only two parts: a rigid insert and an elastic tube. In addition, a rigid casing is used for protecting the elastic tube.

U.S. Pat. No. 5,314,116 to Krauth et al. relates to the same type pulsator.

SUMMARY

This invention relates to several improvements to the pulsating devices described in my U.S. patent application Ser. No. 07/988,946, now U.S. Pat. No. 5,507,436, and in U.S. Pat. No. 5,314,116. The invention relates to several improvements as follow:

(a) The first improvement relates to the casing which provides protection to the sensitive elastic tube. Because the elastic tube must expand and contract, perforations were made in the casing in order to vent the space surrounding the elastic tube. After some two million pulsating sprinklers were sold, it was found that ants enter the pulsator through the perforations in the casing and chew the elastic tube (Silicon Rubber). By using a casing which has a large space relative to the change in volume of the elastic tube, expansion of the elastic tube can be done without the venting perforations in the casing. In such a case, the volume of air surrounding the elastic tube and enclosed in the casing is only slightly compressed during the expansion of the sleeve. This slight compression of air causes a negligible increase in pressure of the air surrounding the elastic tube but allows the pulsator to be produced without said perforations in the casing.

(b) The second improvement relates to the shape of the barbs which are used for holding the elastic tube fixed. Two forces act on the elastic tube when the pulsator is in operation. The pressure of the fluid, inside the elastic tube, causes the elastic tube to expand. At the same time, a force is applied on the elastic tube, directed from the inlet side of the pulsator to its outlet side. This force tries to push the elastic tube out from the insert. When the elastic tube moves, even slightly, from its fixed location the pulsator does not operate properly and consistently. In order to solve this problem, sharp barbs are used for holding the elastic tube in a fixed position.

(c) The third improvement relates to additional barb. To ensure that the pulsator will operate properly with consistent performance, the round elastic tube should be maintained in the latitudinal center of the pulsator all along the pulsator. As the elastic tube expands and contracts, it can reach a position at which the elastic tube moves from its central location and expands with a belly. In order to prevent this, a central barb is used for keeping the elastic tube medial throughout its entire length around the insert.

(d) The forth improvement relates to the properties of the elastic tube.

Using a section of elastic tube is much less expensive compared with a molded injected elastic tube (as illustrated in FIG. 7 of U.S. Pat. No. 5,314,116). Because the inside diameter of the elastic tube has to be smaller than the outside diameter of the rigid insert, assembling a flexible section of extruded elastic tube on the rigid insert was found to be complicated and time consuming. Trying to solve the problem by using an injected elastic tube, with different diameters and wall thicknesses along its longitude cross section, has created other problems, as follows:

the elastic tube has to be held fixed in its place by clamping the elastic tube to the insert. (see U.S. Pat. No. 5,314,116)

clamping of the sleeve has created a stress on the elastic tube which causes the pulsators to operate inconsistently. The suggested solution to these problems is the use of an extruded section of elastic tube with low flexibility. The low flexibility of the tube can be achieved by using the proper rubber compound, thicker tubes, or a combination of the two. Such a tube can be easily assembled on the rigid insert.

Each of the above described improvements has a value by itself and as for example, for some applications (which are described in U.S. patent application Ser. No. 07/988,946, now U.S. Pat. No. 5,507,436,) perforations in the casing are required yet pulsators like this with sharp edges barb will be more consistent in their operation. At the same logic, a pulsator with molded elastic tube (with different inside and outside diameters along its longitude cross section) has many advantages when its casing has no venting perforations.

OBJECTS AND ADVANTAGES

Accordingly, several objects and advantages of the present invention are to provide;

(a) pulsators which can be operated also with casing that has no venting perforations.

(b) pulsators which are more reliable and consistent in their operation.

(c) pulsators which are less complicate and less expensive to produce and assemble.

DETAILED DESCRIPTION OF THE PREFERRED EMBODIMENT OF THIS INVENTION

Figure 1:
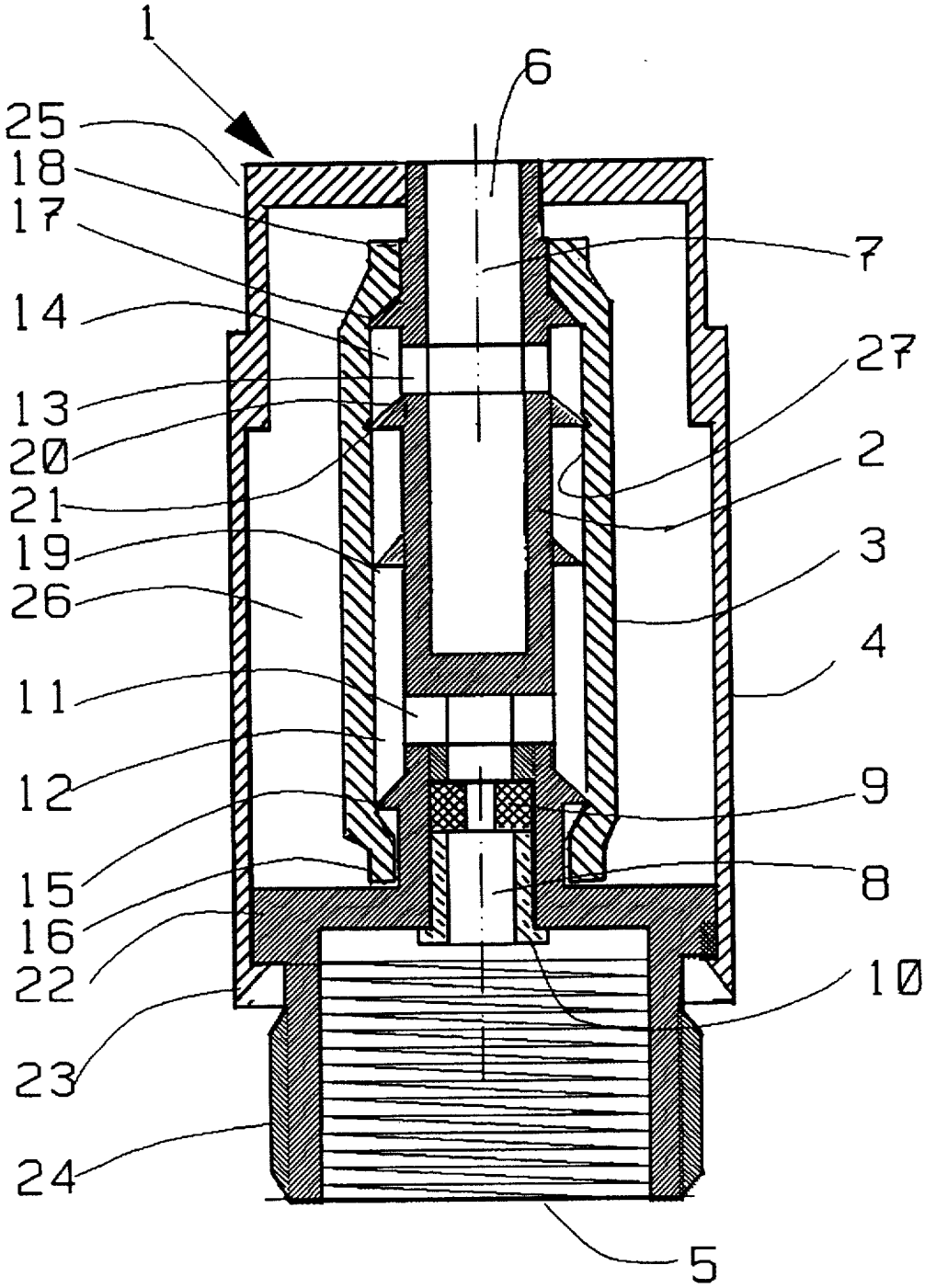
FIG. 1 shows in a longitude cross section an improved pulsator at its normally-closed position.

FIG. 1 shows the improved pulsator in a longitude cross section at the position in which the pulsator is closed.

Pulsator 1 consists of insert 2, elastic tube 3, and casing 4. Its fluid inlet 5 is formed with a female pipe thread and its fluid outlet 6 is formed with a cylindrical-shaped hole 7. Hole 8 at its inlet portion is formed as a housing for flow control 9, which is held at a fixed place by means of retainer 10. Perforations 11 at the inlet portion of insert 2 form a fluid communication between hole (housing) 8 and space 12.

Perforations 13 at the outlet portion of insert 2 form fluid communication between space 14 and outlet hole 7. Barb 15 is made with sharp edges for holding one end 16 of elastic tube 3 in a fixed position and barb 17 is made for holding the other end 18 of elastic tube 3 at a fixed position. Barb 19, which is formed in the proximity of the longitudinal center of insert 2, is used for preventing elastic tube 3 from moving out of its latitudinal central position at any cross section along insert 2. Barb 20 control is the pressure at which the outlet 21 from space 12 opens. At the normal position of pulsator 1, elastic tube 3 surrounds and is in contact with barb 20, pressing on barb 20 and thereby creating a normally-closed valve at this section of insert 2, around barb 20 (closing outlet 21) preventing fluid to flow from space 12 to space 14. Insert 2 is formed with shoulder 22 which can be used for connecting casing 4 to insert 2 by means of snapping casing 4 as shown by detail 23, or by other means (threads, cementing etc.) Insert 2 is formed with ribs 24 for use with a pipe wrench (connecting and disconnecting the pulsator to a threaded nipple). Circumference 25 of casing 4 is made for connecting a sprinkler or any other device to the pulsator. Space 26 which surrounds elastic tube 3 and is enclosed in casing 4 has a relative large volume so that when elastic tube 3 expands, the volume of air in space 26 slightly decreases, causing the pressure of air inside space 26 to only slightly increase at a negligible value, eliminating the stress on elastic tube 3 and allowing it to freely expand without the need of venting space 26.

Figure 2:
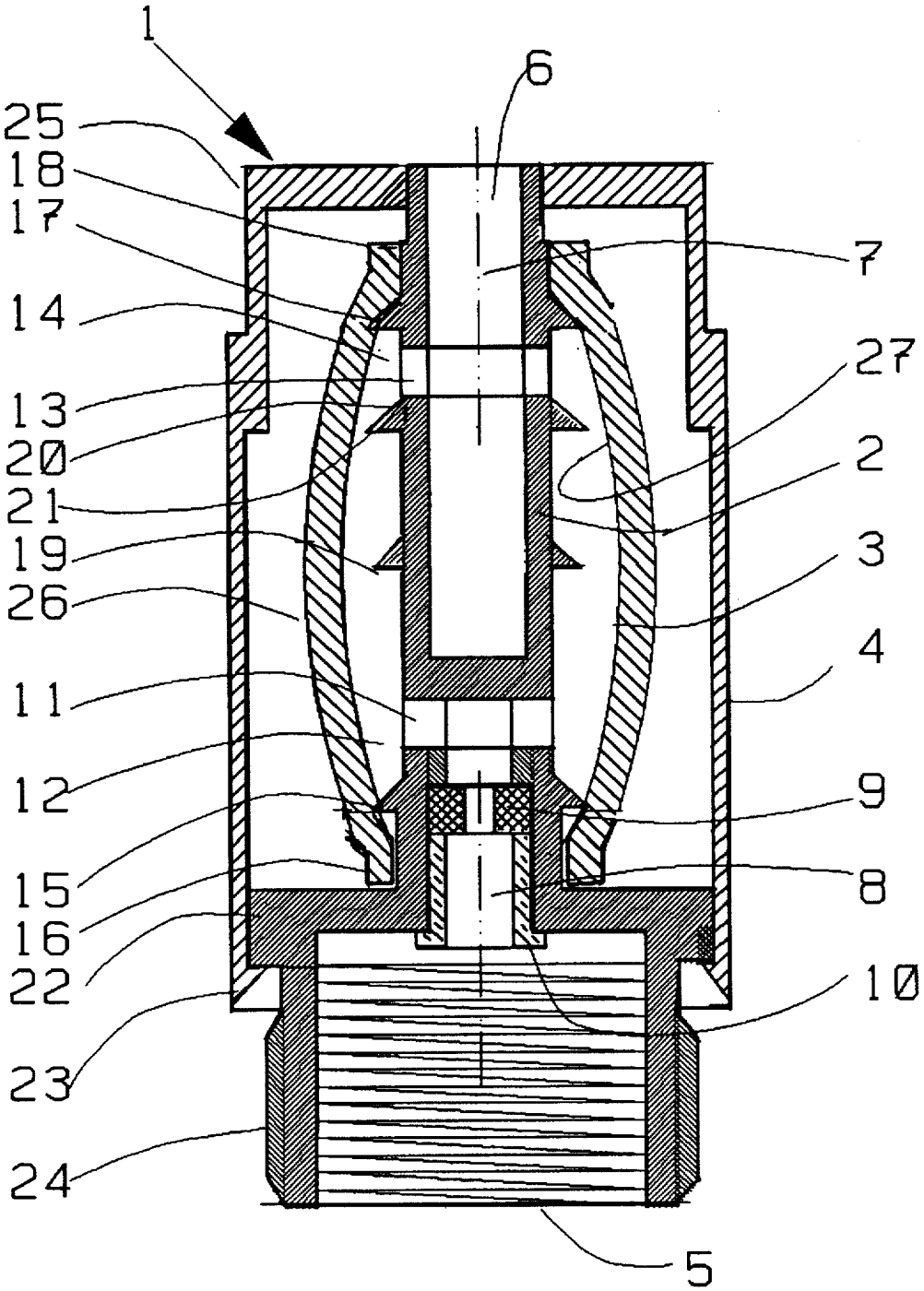
FIG. 2 shows in a longitude cross section the same improved pulsator at its open position.

FIG. 2 shows in a longitude cross section the same improved pulsator at its open position.

Operation FIG. 1 and FIG. 2

Pressurized fluid flows into pulsator 1 through its fluid inlet 5 and then through flow control 9, which controls its flow at a relative low rate. The fluid then continues through perforations 11 into space 12. At this stage outlet 21 from space 12 is closed and the fluid accumulates in space 12. As the volume of fluid in space 12 increases, the pressure in space 12 likewise increases. In response to the increased pressure inside space 12, the portion of elastic tube 3 which surrounds space 12, expands and its inside diameter 27 increases until at a pressure P1 it becomes larger than the outside diameter of barb 20. At this stage, an opening 21 is created around barb 20 which allows the fluid to flow from space 12 to space 14, at the same, low, controlled flow q it passes through flow control 9. As the fluid passes a narrow opening 21, hydraulic resistance dP is created at the narrow opening 21 or anywhere downstream from opening 21 in response to the flow q, forcing the pressure inside space 12 to increase by dP from P1 to P2. Pressure P2 inside space 12 causes additional expansion of elastic tube 3 and its inside diameter 27 becomes large enough to create a wider opening 21 around barb 20. The fluid which was accumulated in space 12 is ejected at a high flow Q through the wider opening 21, space 14, perforations 13, hole 7, and out through fluid outlet 6. Simultaneously, the fluid continues to flow into space 12 at a low controlled flow q. After a small volume dV of the fluid is ejected from space 12, the volume of fluid and its pressure inside space 12 drops and elastic tube 3 contracts. This closes outlet 21 and terminates one pulsating cycle.

When elastic tube 3 expands from its closed position shown in FIG. 1 to its position as shown in FIG. 2, the volume V of air in space 26 is decreased by dV. When space 26 is large enough in relation to dV, such a decrease will cause only a negligible increase in the pressure of air in space 26 and as such pulsator 1 can operate also with out venting space 26.

When for example the volume V of space 26 is twenty times larger than dV, the pressure of air in space 26 will increase by only about 0.05 bar, due to the expansion of the elastic tube.

The required outside diameters of the four barbs is in general smaller than the inside diameter of the elastic tube. The exact outside diameter of each of the barbs depends on several factors some of which are; the length of the insert, the inside and outside diameters of the elastic tube, the desired performance of the pulsator etc. The followings are some dimensions I was using in developing one group of pulsators:

the outside diameters of the four barbs are;

barb 15—12.95 mm.
barb 17—13.46 mm.
barb 19—12.19 mm.
barb 20—12.70 mm.

the length of elastic tube used with this pulsator is 4 cm.
the inside diameter of the elastic tube; 9.53 mm.
inside diameter of casing 4: 29.31 mm.
outside diameter of elastic tube:
sample a: 14.29 mm
sample b: 15.88 mm.

Sample b was less flexible and easier to assemble on the insert compared with sample a.

V/dV has a value of about 10. Therefore the Pulsator can operate also without venting space 26.

I claim:

1. A pulsating device having an inlet and an outlet for converting a continuous, relatively low, controlled fluid flow rate entering said inlet of said pulsating device to an intermittent and pulsating high rate of fluid flow ejected from said outlet of said pulsating device, comprising:

(a) an insert having an inlet, an outlet and an outer surface;

(b) an elastic tube which:

(1) normally surrounds and directly contacts at least a major portion of said insert, (2) can be expanded away from said insert to form an expandable chamber between said outer surface of said insert and an inner surface of said elastic tube, (c) said expandable chamber having (a) an inlet portion and (b) an outlet portion intermittently in fluid communication with said inlet and with said outlet of said insert, (d) said inlet of said insert communicating with said inlet portion of said expandable chamber so that fluid flowing into said inlet of said insert will reach said inlet portion of said expandable chamber, (e) said elastic tube, when in said normal state in direct contact with said insert, being shaped so that it directly closes said outlet portion of said expandable chamber so as to (1) prevent fluid communication between said inlet portion of said expandable chamber and said outlet portion of said expandable chamber, and (2) prevent flow of fluid out from said expandable chamber, (f) said elastic tube, when partially expanded in response to fluid pressure within said inlet portion of said expandable chamber exceeding a first predetermined level, being shaped to form a fluid path between said inlet portion of said expandable chamber and said outlet portion of said expandable chamber, (g) said elastic tube, when partially expanded, surrounding and being in contact with said insert in said outlet portion of said expandable chamber and thereby resisting flow of fluid out from said outlet portion of said expandable chamber to said outlet of said insert and thereby causing an increased pressure in said inlet portion of said expandable chamber, resulting in an additional expansion of said elastic tube and opening said outlet portion of said expandable chamber widely and quickly into communication with said outlet of said insert, (h) said pulsating device thus ejecting fluid from said expandable chamber through said outlet of said insert at a high rate of flow so as to cause the volume and pressure of fluid within said expandable chamber to decrease and said elastic tube to close said outlet portion of said expandable chamber in response to decreased pressure, thereby to complete a cycle of an intermittent pulsating flow of fluid through said outlet of said pulsating device, (i) said pulsating device includes also a rigid casing that is without venting perforations at its outer periphery which surrounds said elastic tube and forming a space enclosed inside the inner surface of said rigid casing and the outer surface of said elastic tube and whereas said space which surrounds said elastic tube has a volume which is relatively larger than the volume of said additional expansion of said elastic tube.

2. A pulsating device according to claim 1 wherein said insert is formed with sharp edges barbs for holding both ends of said elastic tube fixed.

3. A pulsating device according to claim 1 wherein said insert is formed with a central barb.

4. A pulsating device according to claim 1 wherein said elastic tube is made with low flexibility.

5. A pulsating device according to claim 1, further including a flow control means connected to said inlet of said pulsating device for controlling said continuous low rate of flow of fluid into said inlet of said pulsating device.

* * * * *